US012667167B2

(12) United States Patent
Sussmann et al.

(10) Patent No.: US 12,667,167 B2
(45) Date of Patent: Jun. 30, 2026

(54) ARTICLE OF FOOTWEAR HAVING A TWIST FASTENER

(71) Applicant: PUMA SE, Herzogenaurach (DE)

(72) Inventors: Reinhold Sussmann, Scheinfeld (DE); Andreas Siegismund, Rueckersdorf (DE)

(73) Assignee: PUMA SE, Herzogenaurach (DE)

( * ) Notice: Subject to any disclaimer, the term of this patent is extended or adjusted under 35 U.S.C. 154(b) by 127 days.

(21) Appl. No.: 18/376,943

(22) Filed: Oct. 5, 2023

(65) Prior Publication Data

US 2024/0115008 A1 Apr. 11, 2024

Related U.S. Application Data

(60) Provisional application No. 63/413,812, filed on Oct. 6, 2022.

(51) Int. Cl.
*A43C 11/16* (2006.01)
*A43C 5/00* (2006.01)

(52) U.S. Cl.
CPC ..... *A43C 11/16* (2013.01); *A43C 5/00* (2013.01)

(58) Field of Classification Search
CPC ..... A43C 11/16; A43C 11/165; A43C 5/00; A43C 11/18
See application file for complete search history.

(56) References Cited

U.S. PATENT DOCUMENTS 6,032,387 A 3/2000 Johnson
6,438,872 B1 * 8/2002 Chil ..... A43B 3/26 36/97
6,896,128 B1 5/2005 Johnson
2007/0266598 A1 * 11/2007 Pawlus ..... A43B 13/16 36/76 R
2008/0301919 A1 12/2008 Ussher
2013/0269219 A1 * 10/2013 Burns ..... A43C 7/08 242/395
2015/0089839 A1 * 4/2015 James ..... A43C 11/004 36/102
2017/0367439 A1 12/2017 Fallon
2018/0029207 A1 * 2/2018 Hieronymus ..... B25B 27/00
2018/0160775 A1 * 6/2018 Pollack ..... B65H 75/4492
2018/0295943 A1 10/2018 Fallon et al.
2020/0054096 A1 * 2/2020 Beers ..... A43C 11/16
2020/0282542 A1 * 9/2020 Petursson ..... B25G 1/102

FOREIGN PATENT DOCUMENTS

EP 3182254 A2 6/2017
KR 100807105 B1 2/2008

OTHER PUBLICATIONS

PCT International Search Report and Written Opinion, PCT/IB2023/060019, Feb. 23, 2024, 14 pages.

* cited by examiner

*Primary Examiner* — Khoa D Huynh
*Assistant Examiner* — Erick I Lopez
(74) *Attorney, Agent, or Firm* — Quarles & Brady LLP

(57) ABSTRACT

An article of footwear has an upper and a fastener. The upper is attached to a sole structure. The fastener includes a handle disposed within a first cavity formed at a heel end of the sole structure. The handle is operably coupled to a cable that extends along the sole structure from a heel region to a midfoot region of the footwear. When the handle is rotated, the article of footwear is tightened or loosed within the midfoot region.

14 Claims, 14 Drawing Sheets

ARTICLE OF FOOTWEAR HAVING A TWIST FASTENER

CROSS REFERENCE TO RELATED APPLICATIONS

This application claims the benefit of and priority to U.S. Provisional Application No. 63/413,812, filed on Oct. 6, 2022, which is incorporated by reference herein in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a closure mechanism, and more specifically, a closure with a twist fastener mechanism.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, in many cases, articles of footwear having uppers with an increased comfort and better fit are desired, along with improved closure mechanisms. One common closure mechanism to tighten the upper and the tongue onto a user's foot is by using shoelaces. Although shoelaces certainly provide a closure mechanism, shoelaces can break or become untied. Further, shoelaces can become loose over time, and thereby become less aesthetically appealing. Therefore, there is a need for an article of footwear that can selectively provide a tight fit of the upper and the tongue on the user's foot, and selectively provide a looser fit of the upper and the tongue on the user's foot that utilizes no shoelaces.

SUMMARY

An article of footwear, as described herein, may have various configurations. The article of footwear may have an upper and a sole structure connected to the upper.

In some embodiments, the article of footwear has an upper and a fastener. The upper is attached to a sole structure. The fastener includes a handle disposed within a first cavity formed at a heel end of the sole structure. The handle is operably coupled to a cable that extends along the sole structure from a heel region to a midfoot region of the article of footwear. The rotation of the handle tightens or loosens the article of footwear within the midfoot region.

In some embodiments, the article of footwear has an upper and a fastener. The upper is attached to a sole structure. The fastener includes a handle disposed at a heel end of the sole structure. A first cable extends from the sole structure to a portion of the upper. The handle is operably connected to the first cable. The rotation of the handle in a first direction is configured to apply a tensioning force on the first cable.

In some embodiments, the article of footwear has an upper and a fastener. The upper is attached to a sole structure. The fastener includes a handle disposed at a heel end of the sole structure. A first slat extends from the sole structure along the upper. A shaft operably connects the handle to the first slat. The handle and the shaft are configured to be rotated within the sole structure to adjust a tightness of the footwear. The first slat is configured to be translated into the sole structure by rotation of the shaft.

In some embodiments, the handle is made from a cylindrical body, a square body, or a rectangular body. It is also contemplated that other configurations may be implemented.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
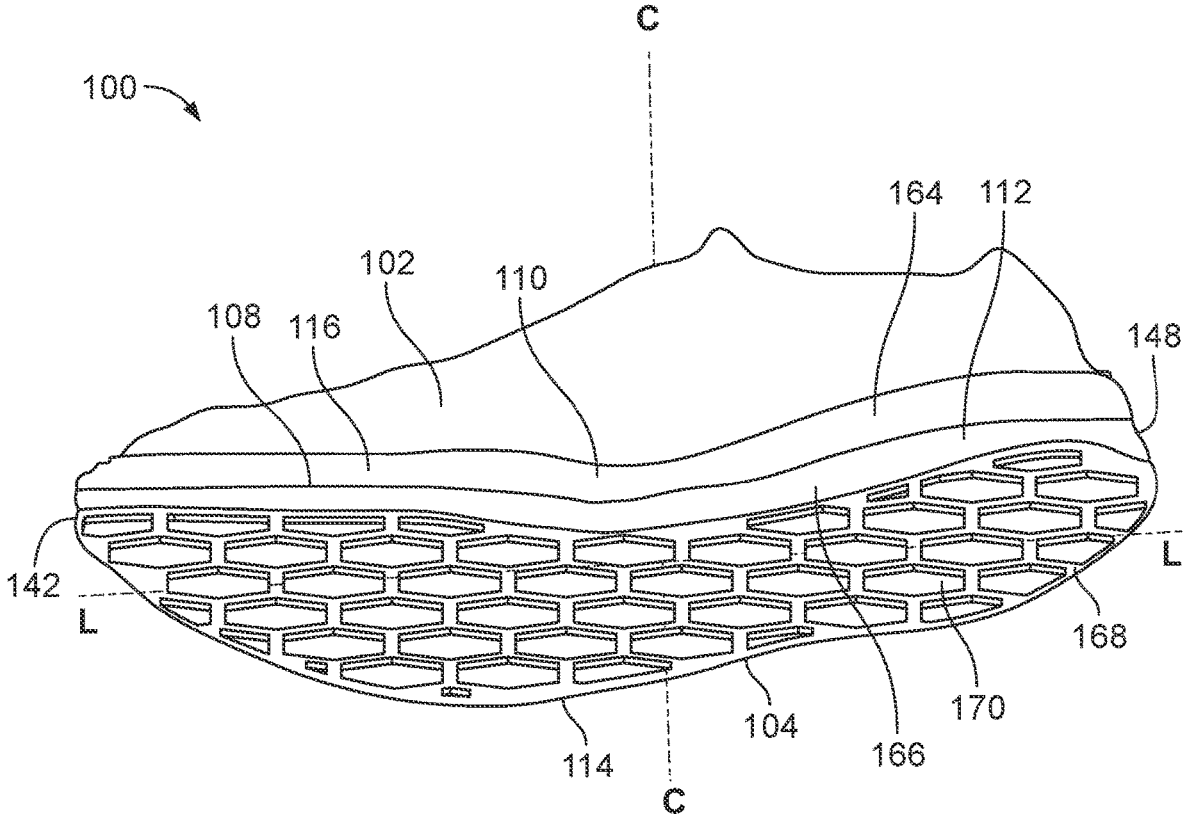
FIG. 1 is a perspective view of a bottom and medial side of an article of footwear configured as a right shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

Figure 2:
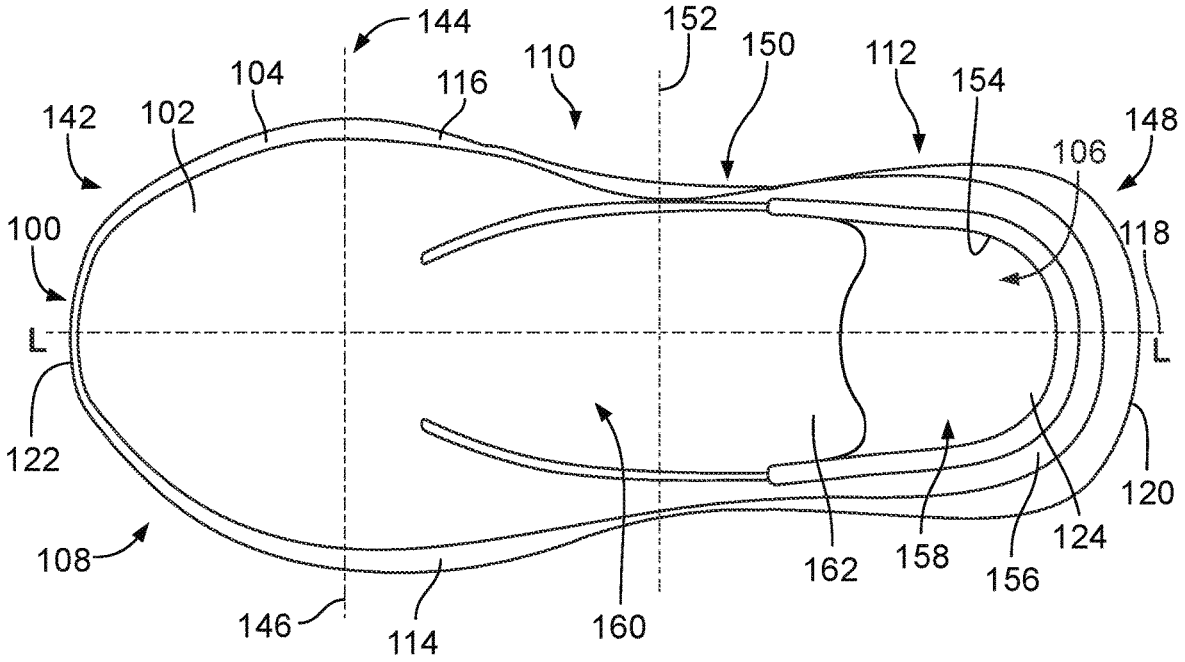
FIG. 2 is a top view of the article of footwear of FIG. 1.
Figure 3:
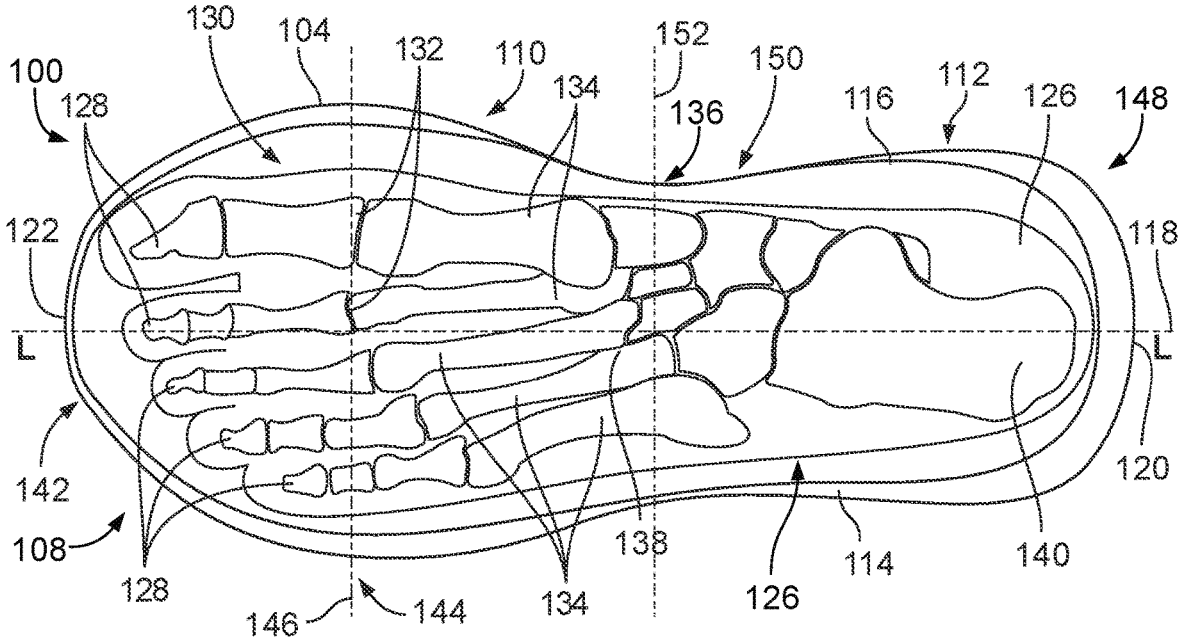
FIG. 3 is a top plan view of the article of footwear of FIG. 1 with the upper removed and a user's skeletal foot structure overlaid thereon.

FIGS. 1-3 depict an exemplary embodiment of an article of footwear 100 including an upper 102 (see FIGS. 1 and 2) and a sole structure 104. The upper 102 is attached to the sole structure 104 and together define an interior cavity 106 (see FIG. 2) into which a foot may be inserted. For reference, the article of footwear 100 defines a forefoot region 108, a midfoot region 110, and a heel region 112. The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements (e.g., textiles, polymer foam, polymer sheets, leather, and synthetic leather) that are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

Referring to FIGS. 1 and 2, with reference to the material (s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

Still referring to FIGS. 1 and 2, in some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

The sole structure 104 is connected or secured to the upper 102 and extends between a foot of a user and the ground when the article of footwear 100 is worn by the user. The sole structure 104 may include one or more components, which may include an outsole, a midsole, a heel, a panel, and/or an insole. For example, in some embodiments, a sole structure may include an outsole that provides structural integrity to the sole structure, along with providing traction for a user, a midsole that provides a cushioning system, and an insole that provides support for an arch of a user. In addition, the insole may be a strobel board, a forefoot board, a lasting board, etc., or a combination thereof, and the insole may be provided between the upper 102 and the sole structure 104, or the insole may be provided as part of the upper 102.

Still referring to FIGS. 1 and 2, furthermore, the insole can be positioned within the interior cavity of the upper, which can be in direct contact with a user's foot while an article of footwear is being worn. Moreover, an upper may also include a liner (not shown) that can increase comfort, for example, by reducing friction between the foot of the user and the upper, the sole, the insole, or the like, and/or by providing moisture wicking properties. The liner may line the entirety of the interior cavity or only a portion thereof. In some embodiments, a binding (not shown) may surround the opening of the interior cavity to secure the liner to the upper and/or to provide an aesthetic element on the article of footwear.

Referring to FIGS. 2 and 3, the article of footwear 100 also defines a lateral side 114 and a medial side 116. When a user is wearing the shoes, the lateral side 114 corresponds with an outside-facing portion of the article of footwear 100 while the medial side 116 corresponds with an inside-facing portion of the article of footwear 100. As such, the article of footwear 100 has opposing lateral sides 114 and medial sides 116. The medial side 116 and the lateral side 114 adjoin one another along a longitudinal central plane or central axis 118 of the article of footwear 100, which is coplanar with the longitudinal axis L of FIG. 1. As will be further discussed herein, the central axis 118 may demarcate a central, intermediate axis between the medial side 116 and the lateral side 114 of the article of footwear 100. Put differently, the central axis 118 may extend between a rear, proximal end 120 of the article of footwear 100 and a front, distal end 122 of the article of footwear 100 and may continuously define a middle of an insole 124, the sole structure 104, and/or the upper 102 of the article of footwear 100, i.e., the central axis 118 is a straight axis extending through the rear, proximal end 120 of the heel region 112 to the front, distal end 122 of the forefoot region 108.

Referring to FIG. 3, unless otherwise specified, the article of footwear 100 may be defined by the forefoot region 108, the midfoot region 110, and the heel region 112. The forefoot region 108 may generally correspond with portions of the article of footwear 100 that encase portions of a foot 126 that include a set of toes or phalanges 128, a ball of the foot 130, and a set of joints 132 that connect a set of metatarsals 134 of the foot 126 with the set of toes or phalanges 128. The midfoot region 110 is proximate and adjoins the forefoot region 108. The midfoot region 110 generally corresponds with portions of the article of footwear 100 that encase an arch 136 of the foot 126, along with a bridge 138 of the foot 126. The heel region 112 is proximate to the midfoot region 110 and adjoins the midfoot region 110. The heel region 112 generally corresponds with portions of the article of footwear 100 that encase rear portions of the foot 126, including a heel or calcaneus bone 140, an ankle (not shown), and/or an Achilles tendon (not shown).

Referring to FIGS. 1 and 2, the forefoot region 108, the midfoot region 110, the heel region 112, the medial side 116, and the lateral side 114 are intended to define boundaries or areas of the article of footwear 100. To that end, the forefoot region 108, the midfoot region 110, the heel region 112, the medial side 116, and the lateral side 114 generally characterize sections of the article of footwear 100. Certain aspects of the disclosure may refer to portions or elements that are coextensive with one or more of the forefoot region 108, the midfoot region 110, the heel region 112, the medial side 116, and/or the lateral side 114. Further, both the upper 102 and the sole structure 104 may be characterized as having portions within the forefoot region 108, the midfoot region 110, the heel region 112, and/or along the medial side 116 and/or the lateral side 114. Therefore, the upper 102 and the sole structure 104, and/or individual portions of the upper 102 and the sole structure 104, may include portions thereof that are disposed within the forefoot region 108, the midfoot region 110, the heel region 112, and/or along the medial side 116 and/or the lateral side 114.

Referring to FIGS. 2 and 3, the forefoot region 108, the midfoot region 110, the heel region 112, the medial side 116, and the lateral side 114 are shown in detail. The forefoot region 108 extends from a toe end 142 to a widest portion 144 of the article of footwear 100. The widest portion 144 is defined or measured along a first line 146 that is perpendicular with respect to the central axis 118 that extends from a distal portion of the toe end 142 to a distal portion of a heel end 148, which is opposite the toe end 142. The midfoot region 110 extends from the widest portion 144 to a thinnest portion 150 of the article of footwear 100. The thinnest portion 150 of the article of footwear 100 is defined as the thinnest portion of the article of footwear 100 measured across a second line 152 that is perpendicular with respect to the central axis 118. The heel region 112 extends from the thinnest portion 150 to the heel end 148 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 116, and/or the lateral side 114 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 116, and/or the lateral side 114 discussed herein.

Still referring to FIGS. 2 and 3, the medial side 116 begins at the distal, toe end 142 and bows outward along an inner side of the article of footwear 100 along the forefoot region 108 toward the midfoot region 110. The medial side 116 reaches the first line 146, at which point the medial side 116 bows inward, toward the central axis 118. The medial side 116 extends from the first line 146, i.e., the widest portion 144, toward the second line 152, i.e., the thinnest portion 150, at which point the medial side 116 enters into the midfoot region 110, i.e., upon crossing the first line 146. Once reaching the second line 152, the medial side 116 bows outward, away from the central axis 118, at which point the medial side 116 extends into the heel region 112, i.e., upon crossing the second line 152. The medial side 116 then bows outward and then inward toward the heel end 148, and terminates at a point where the medial side 116 meets the central axis 118.

The lateral side 114 also begins at the distal, toe end 142 and bows outward along an outer side of the article of footwear 100 along the forefoot region 108 toward the midfoot region 110. The lateral side 114 reaches the first line 146, at which point the lateral side 114 bows inward, toward the central axis 118. The lateral side 114 extends from the first line 146, i.e., the widest portion 144, toward the second line 152, i.e., the thinnest portion 150, at which point the lateral side 114 enters into the midfoot region 110, i.e., upon crossing the first line 146. Once reaching the second line 152, the lateral side 114 bows outward, away from the central axis 118, at which point the lateral side 114 extends into the heel region 112, i.e., upon crossing the second line 152. The lateral side 114 then bows outward and then inward toward the heel end 148 and terminates at a point where the lateral side 114 meets the central axis 118.

Referring to FIG. 2, the upper 102 extends along the lateral side 114 and the medial side 116, and across the forefoot region 108, the midfoot region 110, and the heel region 112 to house and enclose a foot of a user. When fully assembled, the upper 102 also includes an interior surface 154 and an exterior surface 156. The interior surface 154 faces inward and generally defines the interior cavity 106, and the exterior surface 156 of the upper 102 faces outward and generally defines an outer perimeter or boundary of the upper 102. The upper 102 also includes an opening 158 that is at least partially located in the heel region 112 of the article of footwear 100, which provides access to the interior cavity 106 and through which a foot may be inserted and removed. In some embodiments, the upper 102 may also include an instep region 160 that extends from the opening 158 in the heel region 112 over an area corresponding to an instep of a foot to an area proximate the forefoot region 108. The instep region 160 may comprise an area similar to where a tongue 162 of the present embodiment is disposed. In some embodiments, the upper 102 does not include the tongue 162, i.e., the upper 102 is tongueless.

Referring to FIG. 1, the sole structure 104 includes a midsole 164 and an outsole 166. The outsole 166 may define a bottom end or bottom surface 168 of the sole structure 104 across the heel region 112, the midfoot region 110, and the forefoot region 108. Further, the outsole 166 may be a ground-engaging portion or include a ground-engaging surface of the sole structure 104 and may be opposite of the insole thereof. As illustrated in FIG. 1, the bottom surface 168 of the outsole 166 may include a tread pattern 170 that can include a variety of shapes and configurations. The outsole 166 may be formed from one or more materials to impart durability, wear-resistance, abrasion resistance, or traction to the sole structure 104. In some embodiments, the outsole 166 may be formed from any kind of elastomer material, e.g., rubber, including thermoset elastomers or thermoplastic elastomers, or a thermoplastic material, e.g., thermoplastic polyurethane (TPU). In some embodiments, the outsole 166 may define a shore A hardness up to 95. In addition, the outsole 166 may be manufactured by a process involving injection molding, vulcanization, printing layer by layer, i.e., additive manufacturing systems or methods, and the like.

The midsole 164 may be individually constructed from a thermoplastic material, such as polyurethane (PU), for example, and/or an ethylene-vinyl acetate (EVA), copolymers thereof, or a similar type of material. In other embodiments, the midsole 164 may be an EVA-Solid-Sponge ("ESS") material, an EVA foam (e.g., PUMA® ProFoam Lite™, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 164 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 164 is manufactured by a process involving injection molding, vulcanization, printing layer by layer, i.e., additive manufacturing systems or methods, and the like.

Referring to FIG. 1, in the embodiments where the midsole 164 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 164 may be formed using alternative methods known in the art, including the use of an expansion press, an injection machine, a pellet expansion process, a cold foaming process, a compression molding technique, die cutting, or any combination thereof. For example, the midsole 164 may be formed using a process that involves an initial foaming step in which supercritical gas is used to foam a material and then compression molded or die cut to a particular shape.

Figure 4:
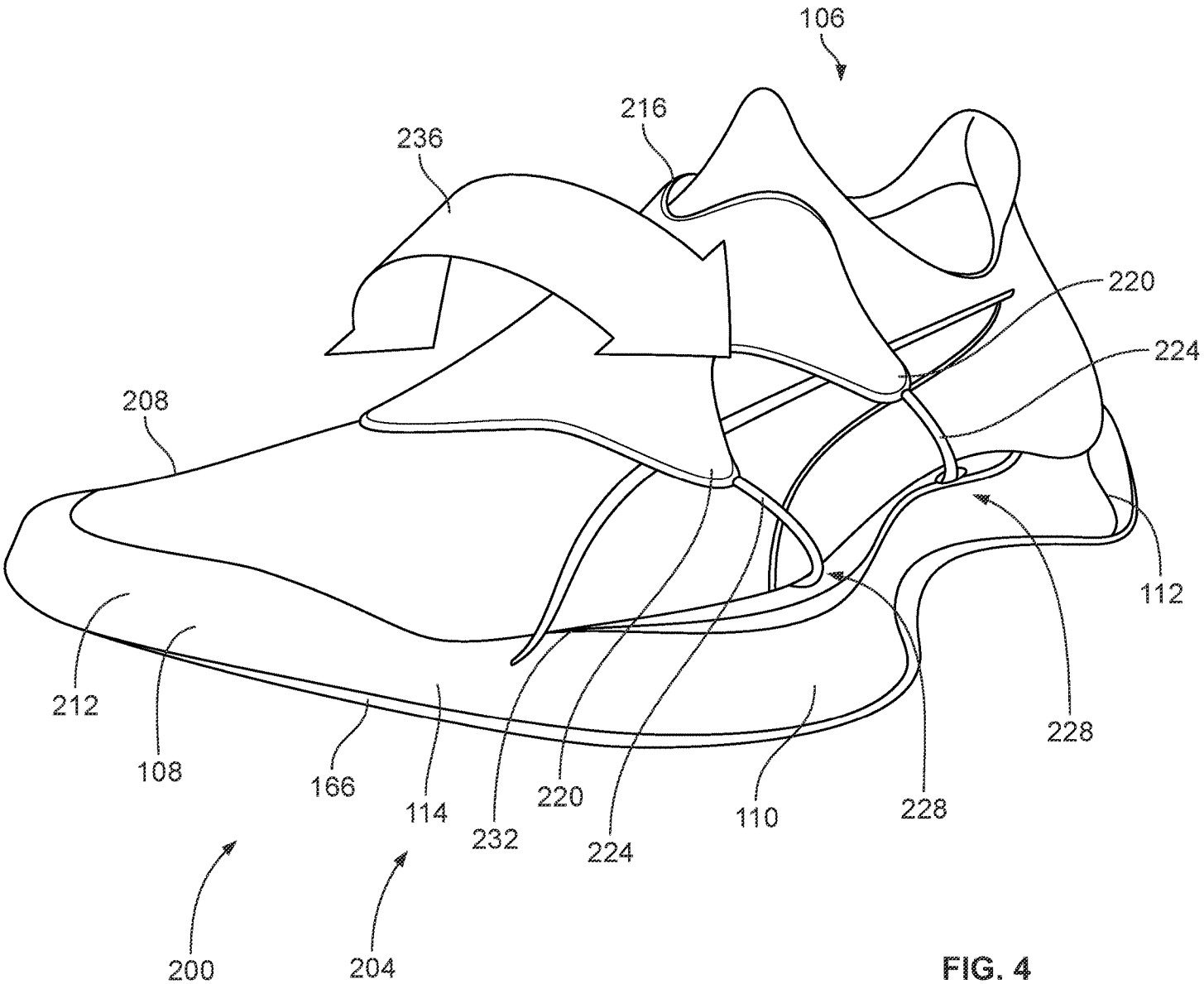
FIG. 4 is a schematic representation of a perspective view of a front and a lateral side of an article of footwear configured as a left shoe, according to an embodiment of the present disclosure.

Referring to FIG. 4, an embodiment of an article of footwear 200 has a first fastener system 204 for tightening and loosening the article of footwear 200 around a user' foot. In the illustrated embodiment, the article of footwear 200 includes an upper 208, a midsole 212, the outsole 166, the forefoot region 108, the midfoot region 110, the heel region 112, the lateral side 114, and the interior cavity 106. In addition, the article of footwear 200 has a panel 216 with a plurality of eyelets 220. The first fastener system 204 includes a plurality of cables 224 that extend from the plurality of eyelets 220 to a plurality of first openings 228 located on a first or top surface 232 of the midsole 212. The plurality of cables 224 can be secured by, e.g., adhesive, crimping, tying a knot at the end of each of the respective plurality of cables 224, an interference fit, welding, overmolding, or the like. When the plurality of cables 224 are in tension, the panel 216 is pressed down upon the upper 208 by a downward force 236 applied as a result of actuating the first fastening system 204, as represented in FIG. 4.

Figure 5:
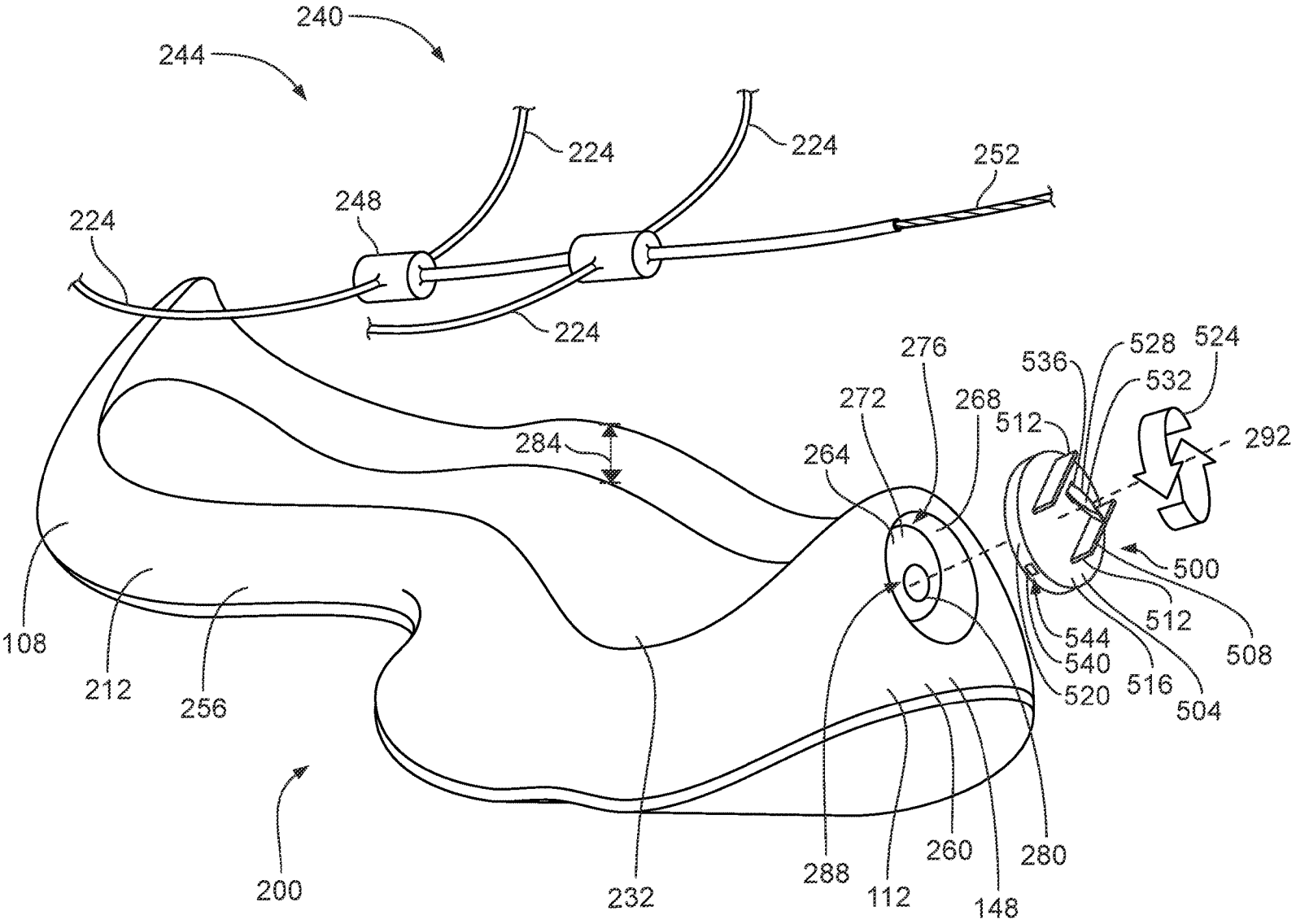
FIG. 5 is a schematic representation of an exploded perspective view of a cable twist fastener, a midsole suitable for use with the article of footwear of FIG. 4 configured as a right shoe, and a handle.

Referring to FIG. 5, the first fastener system 204 includes a first fastener mechanism 240 that utilizes a cable twist fastener 244. In the illustrated embodiment, the cable twist fastener 244 includes a winding assembly 248, a braided shaft 252, and the plurality of cables 224 which are suitable for supplying the downward force 236 on the panel 216 of FIG. 4. Additionally, the midsole 212 includes a second body 256 with a second or heel surface 260 that forms part of the heel end 148, facing outwardly therefrom. The heel surface 260 includes a third or recessed surface 264 located in the heel region 112 and, as illustrated in FIG. 5, at the heel end 148. The recessed surface 264 has a first sidewall 268, and a first base wall 272 which defines the shape of a first cavity 276. The first cavity 276 is in fluid communication with a first passage 280 that extends longitudinally along the midsole 212. The midsole 212 has a first depth 284, indicated by arrows in FIG. 5 for illustrative purposes. The first depth 284 of the midsole 212 is measured from the top surface 232 of the midsole 212 to an upper peripheral edge. The first depth 284 of the midsole 212 increases toward the heel region 112 such that the first passage 280 extends through the midsole 212 in the heel region 112 as the first passage 280 extends to the recessed surface 264. The first passage 280 defines a second aperture 288 which is intersected by a first axis 292 that extends from the heel region 112 to the forefoot region 108. In some embodiments, the first axis 292 intersects the central axis 118 (see FIG. 2). In some embodiments, the first axis 292 is offset laterally from and does not intersect the central axis 118 (see FIG. 2).

A handle 500 has a third body 504 and an actuator mechanism 508 provided as a plurality of grips 512 that project from a fourth or outer handle surface 516, and a fifth surface or circumferential handle surface 520 that circumscribes and projects perpendicularly from the outer handle surface 516. In some embodiments, the handle 500 is configured to fit within the first cavity 276. The plurality of grips 512 can be grasped by a user to facilitate a rotation 524, e.g., clockwise or counterclockwise, of the handle 500 about the first axis 292.

Figure 6:
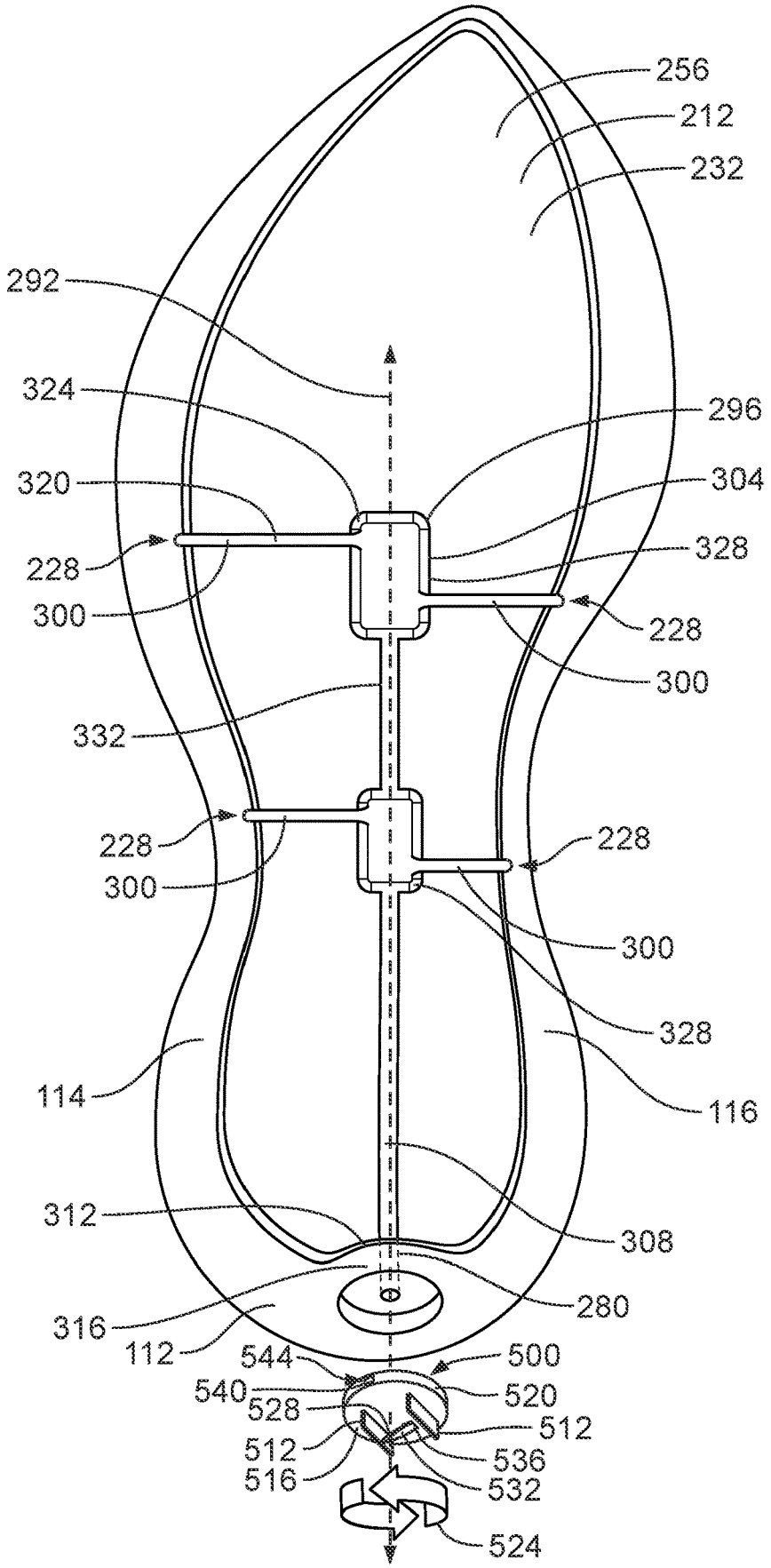
FIG. 6 is a schematic representation of a top view of a midsole that is suitable for use with the article of footwear of FIG. 4 configured as a left shoe, according to an embodiment of the present disclosure.

Referring to FIG. 6, the top surface 232 of the midsole 212 includes a sixth surface or cutout surface 296. The cutout surface 296 can be formed in the top surface 232 during the molding of the midsole 212, or by removing material (e.g., being cut out) from the midsole 212 after the midsole 212 is molded. The cutout surface 296 includes a plurality of first lateral channels 300 which extend from a second or longitudinal channel 304 that is centrally located along or proximate the first axis 292. The plurality of lateral channels 300 extend toward the medial side 116 and the lateral side 114 of the midsole 212. In some embodiments, the plurality of lateral channels 300 extend perpendicularly with respect to the first axis 292. In some embodiments, at least one channel of the plurality of lateral channels 300 extends at an acute angle with respect to the first axis 292. In some embodiments, each channel of the plurality of lateral channels 300 that extend to the medial side 116 of the midsole 212 is offset with respect to each channel of the plurality of lateral channels 300 that extend to the lateral side 114 of the midsole 212 along the first axis 292. That is, the plurality of lateral channels 300 that extend to the medial side 116 of the midsole 212 from longitudinal channel 304 are not aligned with the plurality of lateral channels 300 that extend to the lateral side 114 of the midsole 212 from the longitudinal channel 304 along the first axis 292. In some embodiments, each channel of the plurality of lateral channels 300 that extends to the medial side 116 of the midsole 212 from the longitudinal channel 304 is aligned with one channel of the plurality of lateral channels 300 that extend to the lateral side 114 of the midsole 212 from the longitudinal channel 304 along the first axis 292.

The longitudinal channel 304 formed in the cutout surface 296 further includes a rear channel 308 that extends along the first axis 292 rearwardly to the first passage 280. The top surface 232 of the midsole 212 slopes downwardly, e.g., toward the outsole 166 (see FIG. 4) in the longitudinal direction moving from the heel region 112 toward the forefoot region 108. The rear channel 308, which is on the top surface 232 (i.e. the top surface) of the midsole 212, transitions to and communicates with the first passage 280, which extends through or within the midsole 212. An enclosure 312 is provided as part of the second body 256 of the midsole 212. In the illustrated embodiment, the enclosure 312 surrounds the first passage 280 and includes an upper member 316 that curves convexly relative to the outsole 166 (see FIG. 2) and extends vertically above the top surface 232. In some embodiments, the plurality of lateral channels 300 have a second depth 320 and the longitudinal channel 304 has a third depth 324, the second depth 320 and the third depth 324 being directionally identical to the first depth 284 of FIG. 5. In some embodiments, the third depth 324 is greater, i.e., deeper, than the second depth 320. The longitudinal channel 304 is configured to receive the winding assembly 248 (see FIG. 5), the plurality of lateral channels 300 are configured to receive each of the plurality of cables 224 (see FIG. 5), and the rear channel 308 is configured to receive the braided shaft 252 (see FIG. 5). In some embodiments, the longitudinal channel 304 has a set of receptacles 328 and an intermediate channel 332 extending therebetween. The first axis 292 extends along the centerline of the set of receptacles 328, the at least one intermediate channel 332, the rear channel 308, and the first passage 280.

Figure 7:
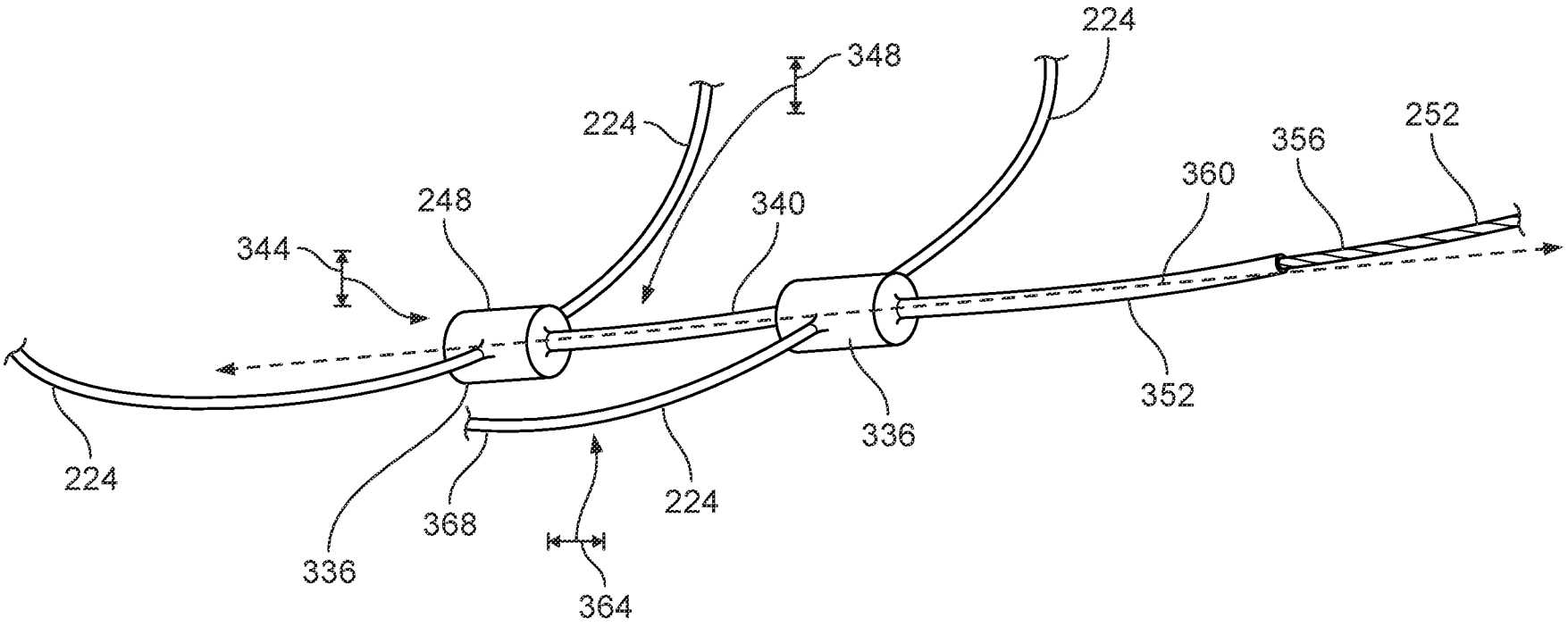
FIG. 7 is a schematic representation of a perspective view of the cable twist fastener of FIG. 5.

Referring to FIG. 7, the cable twist fastener 244 includes the winding assembly 248 and the braided shaft 252 and the plurality of cables 224. In some embodiments, the winding assembly 248 include a set of cores 336 and an intermediate portion 340. The set of cores 336 has a first diameter 344 which is wider than a second diameter 348 of intermediate portion 340. The braided shaft 252 has a first shaft 352 and a plurality of braided wires 356 that are configured to extend from the winding assembly 248 along a second axis 360. The plurality of braided wires 356 are secured to the handle 500 after insertion into the first passage 280 (see FIGS. 5 and 6) by, e.g., adhesive, crimping, tying a knot at the end of the plurality of braided wires 356, an interference fit, welding, overmolding, or the like. In some embodiments, the first shaft 352 and the set of cores 336 of winding assembly 248 are solid objects without any interior cavities or voids. In some embodiments, the first shaft 352, the winding assembly 248, or both, have an interior cavity or void. In some embodiments, the set of cores 336 are hollow and retrieve and store the plurality of cables 224 therein. In some embodiments, the plurality of cables 224 are secured to the winding assembly 248 by, e.g., adhesive, crimping, tying a knot at the end of each of the plurality of cables 224, an interference fit, welding, overmolding, or the like.

Each of the plurality of cables 224 has a length 364 and may be made of a natural material, a plastic material, a metallic wire, a combination of metallic wire and overmolded by plastic, or other combinations thereof. The length 364 of each of the plurality of cables 224 is measured as the length from a far or distal end 368 of each of the plurality of cables 224 to the each respective core 336. Due at least partially to the materials used, each of the plurality of cables 224 is strong enough to hold enough tension to apply the downward force 236 to the panel 216 without breaking (see FIG. 4). Further, each of the plurality of cables 224 is flexible enough to be positioned in the plurality of lateral channels 300 (see FIG. 6), to bend along the medial side 116 or the lateral side 114 of the article of footwear 200 (see FIG. 4), be secured to one of the plurality of eyelets 220 (see FIG. 4), and configured to wrap around or internally within the winding assembly 248 as the braided shaft 252 rotates around the second axis 360. After the handle 500 is secured to the plurality of braided wires 356, the rotation 524 of the handle 500 (see FIG. 5), either clockwise or counter-clockwise, rotates the plurality of braided wires 356. As the rotation 524 of the handle 500 continues (see FIG. 5), the plurality of braided wires 356 twists about the second axis 360 enough to begin to transfer the rotation 524 to the winding assembly 248. As the winding assembly 248 begins to rotate about the second axis 360, the plurality of cables 224 can be wrapped around the first diameter 344 or the second diameter 348 of the winding assembly 248. In this way, the operation of the first fastener system 204 reduces the length 364 of each of the plurality of cables 224. This decrease in the length 364 of the plurality of cables 224 creates tension in each of the plurality of cables 224 so that the downward force 236 can be applied to the panel 216 (see FIG. 4).

Referring to FIGS. 6 and 7, the cable twist fastener 244 (FIG. 7) is configured so that each of the plurality of cables 224 (FIG. 7) fits within one of the plurality of lateral channels 300 (FIG. 6), the braided shaft 252 (FIG. 7) fits within the rear channel 308 and the first passage 280 (FIG. 6) and the winding assembly 248 (FIG. 7) fit within the receptacles 328 of the longitudinal channel 304 (FIG. 6). In addition, when the cable twist fastener 244 (FIG. 7) is inserted onto the cutout surface 296 (FIG. 6), the first axis 292 (FIG. 6) and the second axis 360 (FIG. 7) are aligned. In some embodiments, after the cable twist fastener 244 (FIG. 7) is inserted onto the cutout surface 296 (FIG. 6), the plurality of cables 224 (FIG. 7) are secured to the plurality of eyelets 220 (see FIG. 4), and the plurality of braided wires 356 (FIG. 7) are secured to the handle 500 (see FIG. 5), the insole 124 can be positioned to cover the top surface 232 so that the cutout surface 296 (FIG. 6) and the cable twist fastener 244 (FIG. 7) are covered and the user's foot is cushioned.

Figure 8:
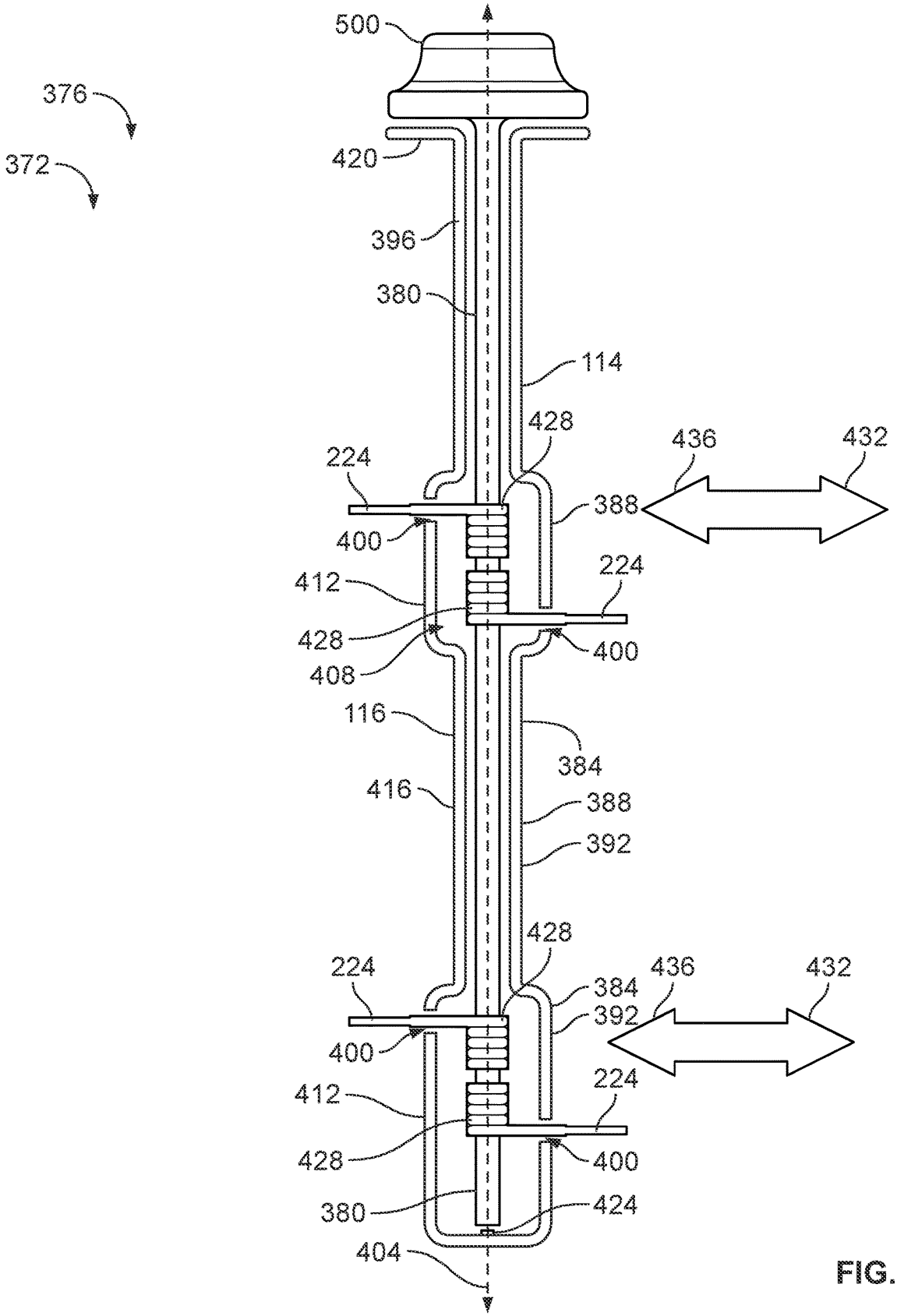
FIG. 8 is a schematic representation of a cross section of a rigid twist fastener that is suitable for use with the article of footwear of FIG. 4.

Referring to FIG. 8, a second fastener mechanism 372 utilizes a rigid twist fastener 376 having a rigid shaft 380, the plurality of cables 224, and a housing 384. The rigid twist fastener 376 can be housed within and/or inserted onto the cutout surface 296 of the midsole 212 of FIG. 6. The housing 384 has a first exterior surface 388 and comprises an intermediate portion 392 and a rear portion 396. The intermediate portion 392 includes a plurality of openings 400 that are positioned laterally and face toward the medial side 116 and the lateral side 114 of the article of footwear 200 (similar to FIG. 6). A third axis 404 extends along the centerline of the rigid shaft 380 and the housing 384. In some embodiments, the third axis 404 intersects the central axis 118 when assembled. In some embodiments, the third axis 404 does not intersect the central axis 118 when assembled. The housing 384 defines an interior cavity 408 in which the rigid shaft 380 is disposed. In some embodiments, the intermediate portion 392 includes a set of cores 412, and at least one connection member 416. The rear portion 396 extends from the intermediate portion 392 toward the handle 500 along the third axis 404. In some embodiments, the rear portion 396 includes a flange 420. The flange 420, when present, provides additional stability for installing, maintaining, and rotating the rigid twist fastener 376 in the cutout surface 296.

The rigid shaft 380 is rotationally secured to a first end 424 of the intermediate portion 392 located in the interior cavity 408 opposite or distant from the first rear portion 396. In some embodiments, the rigid shaft 380 is configured to be inserted through the first passage 280 and then secured to the handle 500. The rigid shaft 380 may be secured to the handle 500 by a variety of means, including by adhesive, by crimping, by an interference fit, by bayonet lock, by welding, or by overmolding. The plurality of cables 224 are secured to the rigid shaft 380, e.g., by adhesive, by crimping, by an interference fit, by knot, by welding, or by overmolding. In some embodiments, the plurality of second openings 400 on the medial side 116 of the housing 384 are offset from any of the plurality of second openings 400 on the lateral side 114 of the housing 384 along the third axis 404. That is, each of the plurality of second openings 400 are staggered with respect to the third axis 404. In some embodiments, each of the plurality of second openings 400 are perpendicular with respect to the third axis 404. Each of the plurality of cables 224 is secured to the rigid shaft 380 and extends through the respective plurality of second openings 400. Each of the plurality of cables 224 is inserted into the plurality of lateral channels 300 and extends through the plurality of first openings 228. Each of the plurality of cables 224 extends up the medial side 116 or the lateral side 114 of the article of footwear 200 to be secured to the plurality of eyelets 220 of the panel 216.

Still referring to FIG. 8, the rotation 524 of the handle 500 (see FIG. 5) rotates the rigid shaft 380, which is rotationally connected to the first end 424 of the intermediate portion 392. The rotation 524 (see FIG. 5) of the rigid shaft 380, either clockwise or counter clockwise, causes each of the plurality of cables 224 to wrap around the rigid shaft 380 forming a coil 428 with the respective set of cores 412. The coils 428 increase or decrease in size, i.e., diameter and/or length, depending upon the rotation 524 of the rigid shaft 380. This in turn creates an extension movement 432 or a retraction movement 436 of each of the plurality of cables 224, which then translates into the downward force 236 on the panel 216 (see FIG. 4). In some embodiments, the downward force 237 increases or decreases in proportion to the size of the coils. In some embodiments, each of the respective coils 428 do not contact another coil 428.

Figure 9:
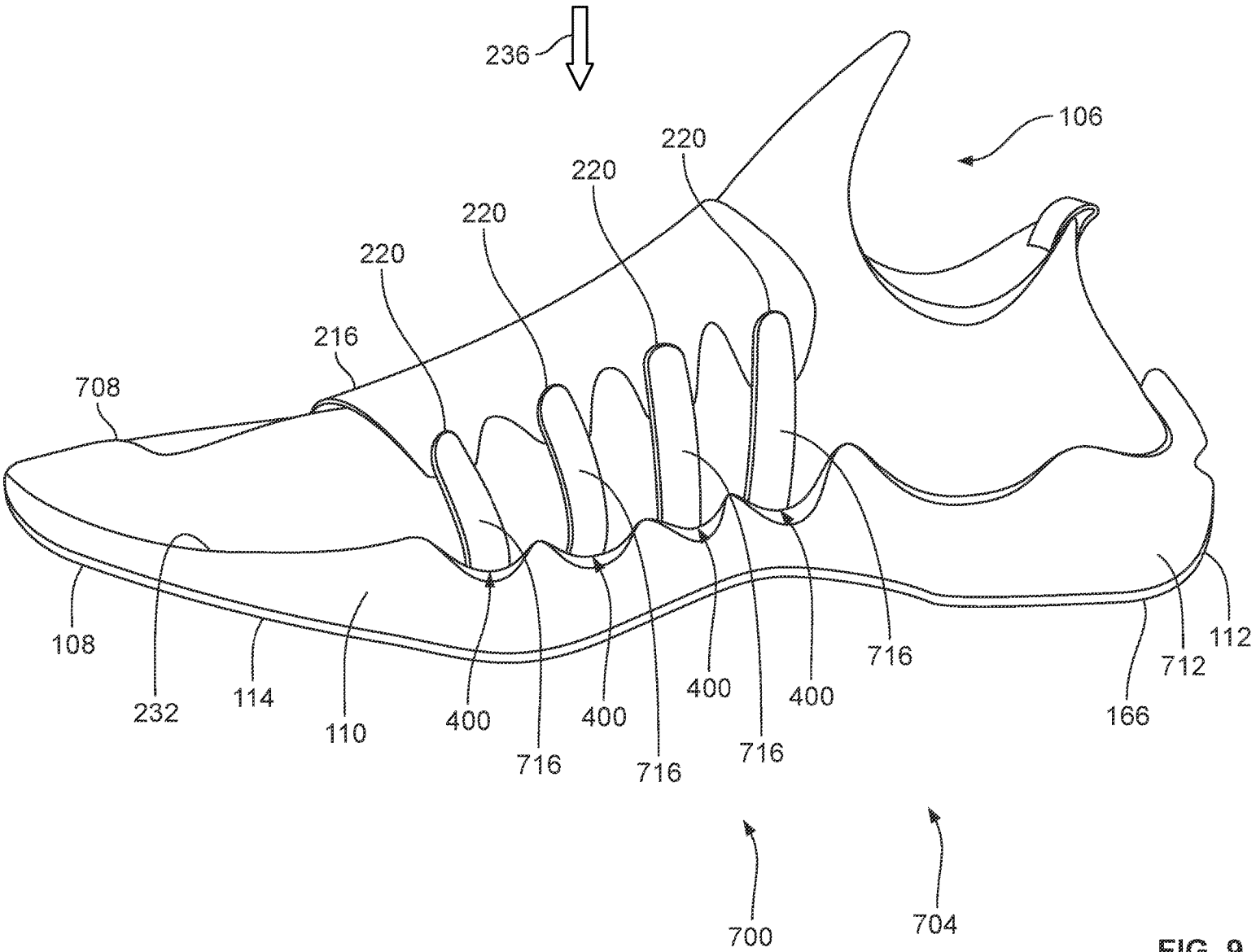
FIG. 9 is a schematic representation of a side view of another article of footwear, according to an embodiment of the present disclosure.

Referring to FIG. 9, a second embodiment of an article of footwear 700 has a second fastener system 704, which shares similar functions and structures with the article of footwear 200 of FIG. 4, such that like reference numerals will be used to indicate like elements. The article of footwear 700 has an upper 708, a midsole 712, the outsole 166, the forefoot region 108, the midfoot region 110, the heel region 112, the lateral side 114, and the interior cavity 106. In addition, the article of footwear 700 has the panel 216 with the plurality of eyelets 220. A plurality of slats 716 extend to and are secured to each of the plurality of eyelets 220. Each of the plurality of slats 716 extend from the plurality of second openings 400 located on the top surface 232 of the midsole 712. Each of the plurality of slats 716 is slat shaped, that is, each of the plurality of slats 716 is flat and wide when compared to the plurality of cables 224 of FIG. 4. The plurality of slats 716 can be secured to each of the plurality of eyelets 220 by a variety of means, including by adhesive, by crimping, by an interference fit, by welding, or by overmolding. The plurality of slats 716 are configured to bend or flex when transitioning from the plurality of second openings 400 to the plurality of eyelets 220. When the plurality of slats 716 are in tension, the panel 216 is pressed down upon the upper 708 by the downward force 236.

Figure 10:
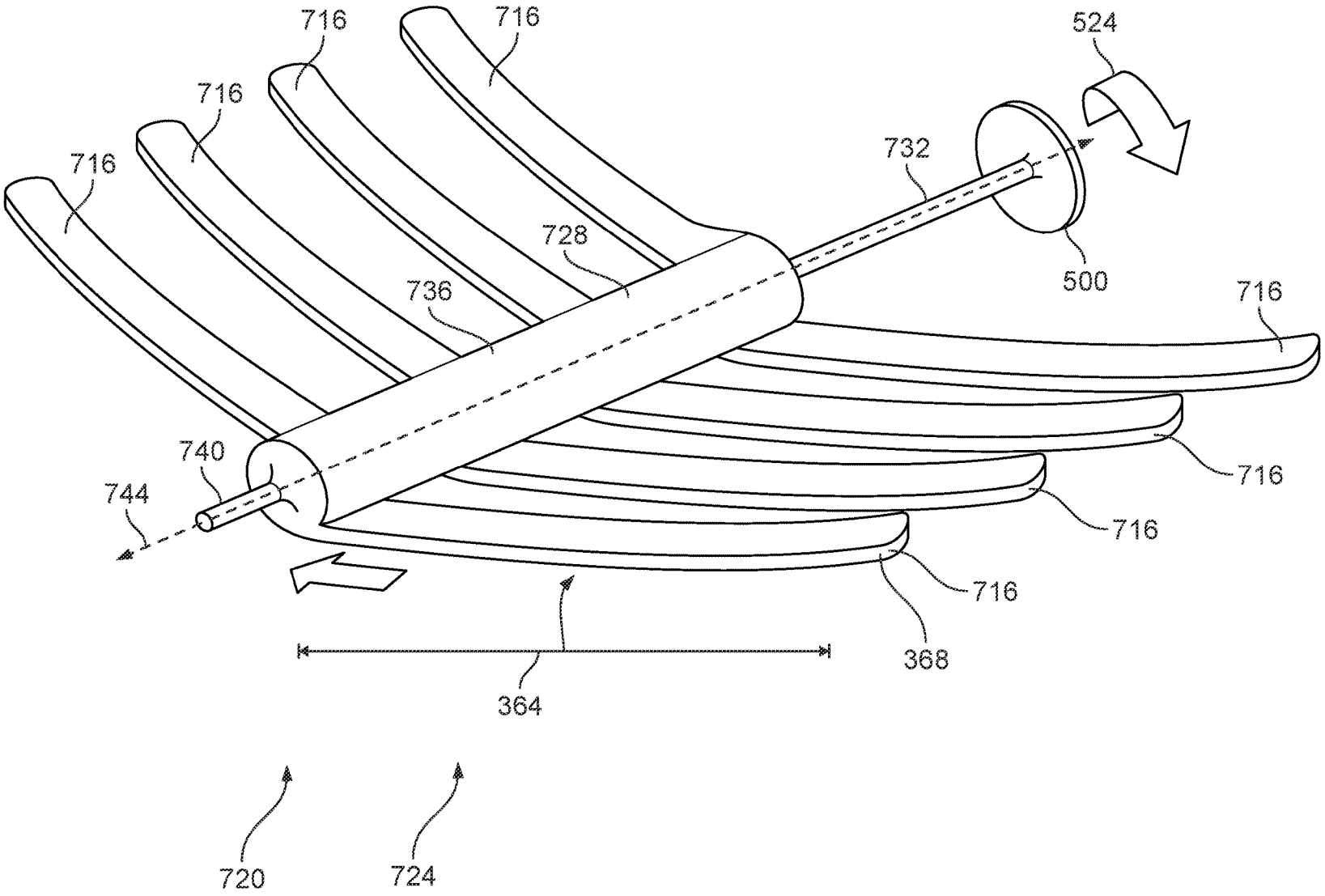
FIG. 10 is a schematic representation of a perspective view of a slat twist fastener that is suitable for use with the article of footwear of FIG. 9.

Referring to FIG. 10, a third fastener mechanism 720 utilizes a slat twist fastener 724 having a fifth body or core 728, a rear shaft 732, and the plurality of slats 716 that project from a seventh or exterior surface 736 of the core 728. In some embodiments, a first projection 740 extends from the exterior surface 736 of the core 728. A fourth axis 744 extends through the first projection 740 (when present), the core 728, and the rear shaft 732. The rear shaft 732 is configured to be secured to the handle 500, e.g., by adhesive, by crimping, by an interference fit, by welding, or by overmolding. The rotation 524 of the handle 500 creates the rotation 524 in the rear shaft 732 and the core 728. As the core 728 rotates, each of the plurality of slats 716 wraps around or unwraps from the core 728, thereby increasing or decreasing the length 364 of each the plurality of slats 716. When the plurality of slats 716 are in tension, the panel 216 is pressed down upon the upper 708 by the downward force 236 (see FIG. 9).

Figure 11:
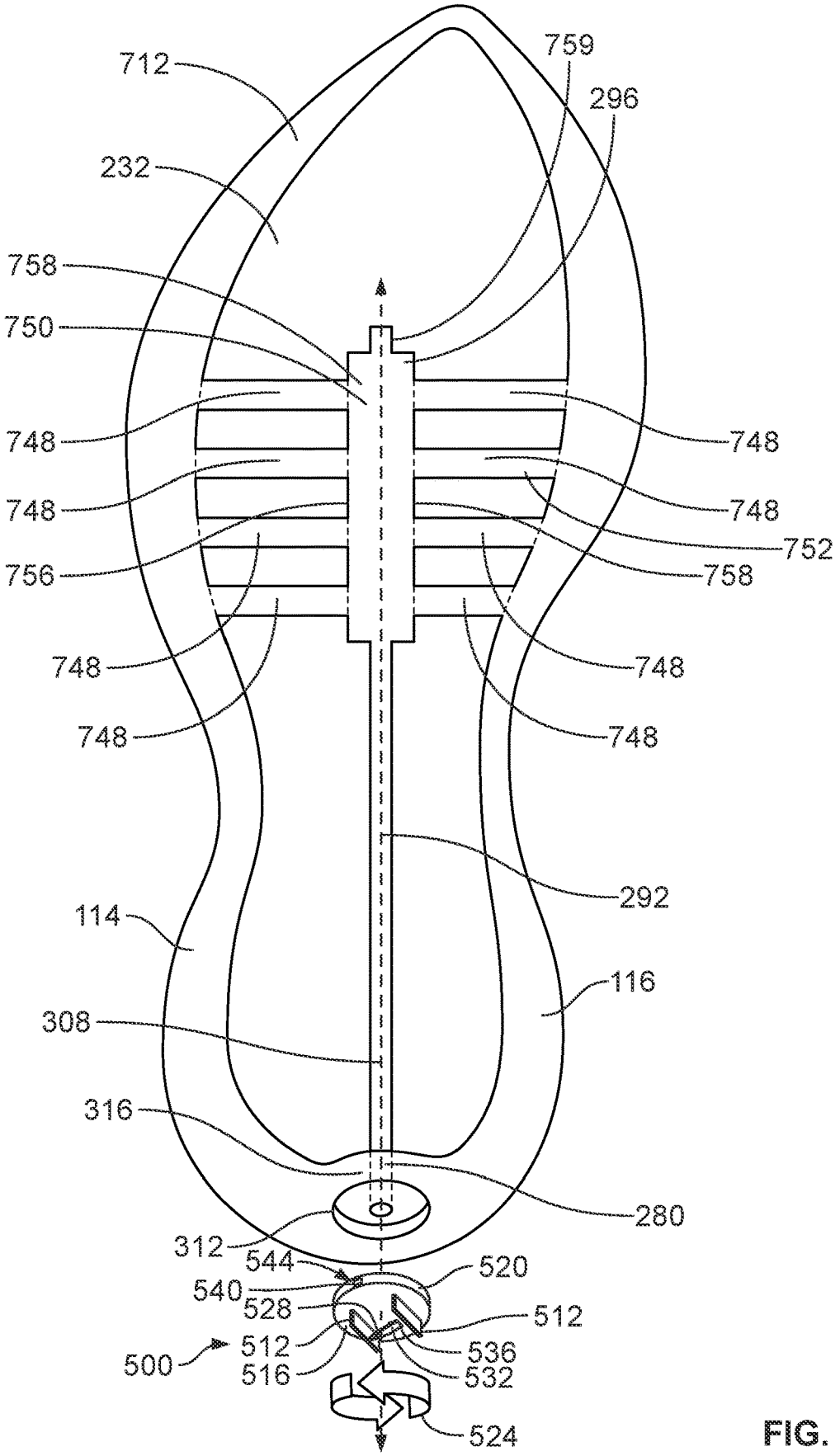
FIG. 11 is a schematic representation of a top view of another midsole that is suitable for use with the article of footwear of FIG. 9 and configured to house the slat twist fastener of FIG. 10.

Referring to FIG. 11, the midsole 712 is similar to the midsole 212 of FIG. 6 and, thus, like reference numerals will be used to indicate like elements. The top surface 232 of the midsole 712 is further defined by the cutout surface 296. The cutout surface 296 can be formed in the top surface 232 during the molding of the midsole 712, or by removing material (e.g., cut out) from the midsole 712 after the midsole 712 is molded. The cutout surface 296 includes a plurality of second channels or lateral channels 748 which extend from a longitudinal channel 750 toward the medial side 116 and the lateral side 114 of the midsole 712. In some embodiments, the plurality of lateral channels 748 extend perpendicularly with respect to the first axis 292. The plurality of lateral channels 748 are each wider than the plurality of lateral channels 300 (see FIG. 6) to accommodate the width of each of the plurality of slats 716. In some embodiments, each channel of the plurality of lateral channels 748 that extends to the medial side 116 of the midsole 712 from the longitudinal channel 750 is offset with respect to each channel of the plurality of lateral channels 748 that extend to the lateral side 114 of the midsole 712 from the longitudinal channel 750 along the first axis 292. That is, the plurality of lateral channels 748 that extend to the medial side 116 of the midsole 712 are not aligned with the plurality of lateral channels 748 that extend to the lateral side 114 of the midsole 712 along the first axis 292. In some embodiments, the plurality of lateral channels 748 are configured to receive the plurality of slats 716 (see FIG. 10). In some embodiments, each channel of the plurality of lateral channels 748 that extend to the medial side 116 of the midsole 712 from the longitudinal channel 750 is aligned with one channel of the plurality of lateral channels 748 that extend to the lateral side 114 of the midsole 712 from the longitudinal channel 750 along the first axis 292.

The cutout surface 296 further includes the rear channel 308 that extends along the first axis 292 from the longitudinal channel 750 to the first passage 280. The rear channel 308, which is on the top surface 232 of the midsole 712, transitions to the first passage 280, which is within the midsole 712 (i.e., no longer on the top surface 232 of the midsole 712). The midsole 712 includes the enclosure 312 and the upper member 316 that extends above the top surface 232. In some embodiments, the plurality of lateral channels 748 have a fourth depth 752, and the longitudinal channel has a fifth depth 756, which are directionally identical to the first depth 284 of FIG. 5. In some embodiments, the fifth depth 756 is greater, i.e., deeper, than the fourth depth 752. The longitudinal channel 750 is configured to retain the core 728 (see FIG. 10), the plurality of lateral channels 748 are configured to retain each of the plurality of slats 716 (see FIG. 10), and the rear channel 308 and the first passage 280 are configured to retain the rear shaft 732 (see FIG. 10). In some embodiments, the longitudinal channel 750 has a receptacle 758 and a distal end 759. The first axis 292 extends along the centerline of the receptacle 758, the distal end 759, the rear channel 308, and the first passage 280. In some embodiments, the distal end 759 is configured to retain the first projection 740 (see FIG. 10), and the receptacle 758 is configured to retain the core 728 (see FIG. 10).

Figure 12:
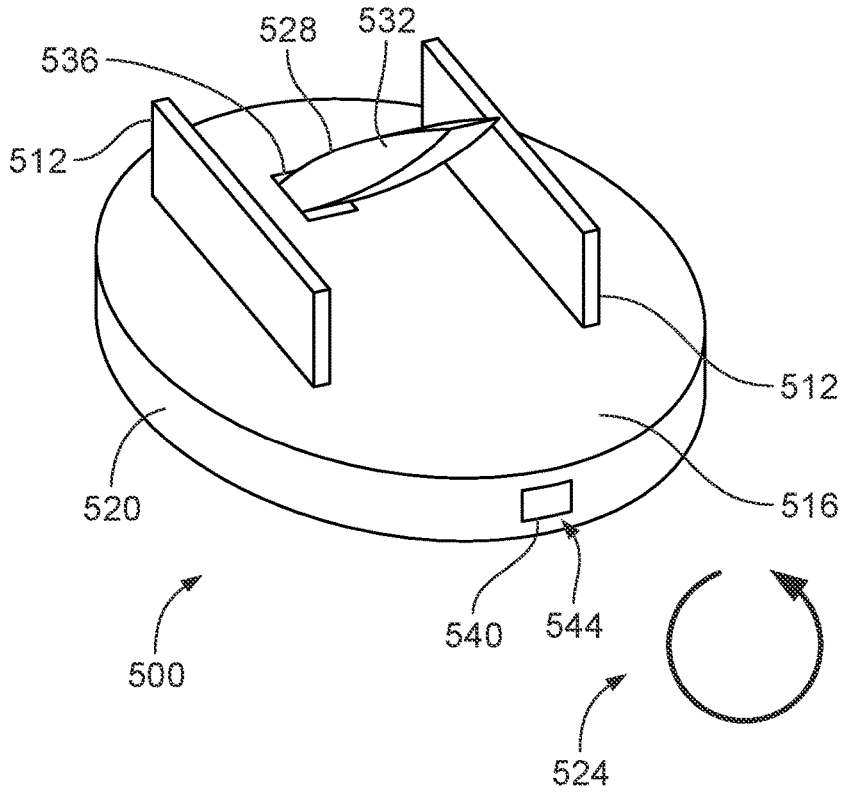
FIG. 12 is a schematic representation of a perspective view of a top and side of the handle of FIG. 5.

Referring to FIG. 12, the handle 500 includes the plurality of grips 512 and a release mechanism 528 utilizing a toggle 532 which project from the outer handle surface 516. The toggle 532 is positioned and tilted within a toggle or third opening 536. A lock slot 540 that contacts the circumferential handle surface 520 defines a fourth opening 544 that projects from the circumferential handle surface 520. The toggle 532 is configured to be rotated, e.g., tilted, toward and away from the lock slot 540. In some embodiments, the plurality of grips 512 project farther from the outer handle surface 516 than the toggle 532. In some embodiments, the plurality of grips 512 and the toggle 532 project the same amount from the outer handle surface 516. In some embodiments, the circumferential handle surface 520 is configured as a circumferentially shaped sidewall, which may facilitate the rotation 524 of the handle 500 within the first cavity 276 (see FIG. 5).

Figure 13:
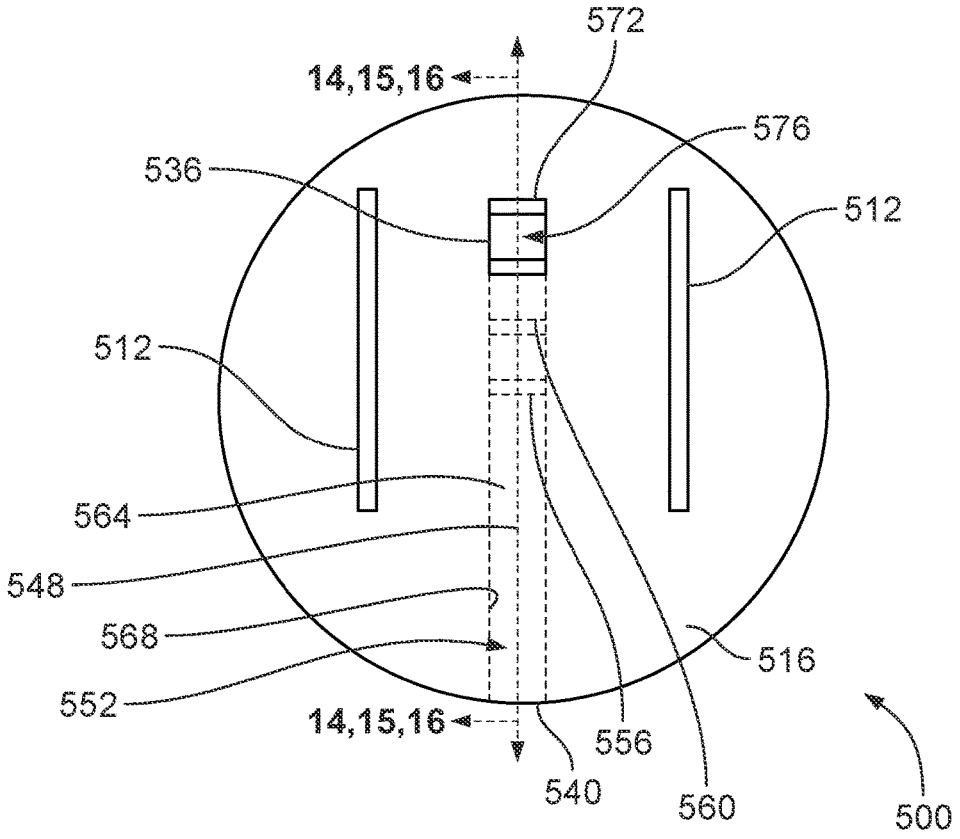
FIG. 13 is a schematic representation of a top view of the handle of FIG. 5 with a lock channel shown in phantom lines.

Referring to FIG. 13, the handle 500 has a fifth axis 548 that intersects the centerline of the third opening 536, the lock slot 540 and a lock channel 552 that connects the lock slot 540 to the third opening 536. In some embodiments, the plurality of grips 512 are oriented parallel to the fifth axis 548. In some embodiments, at least one of the plurality of grips 512 is oriented at an acute angle relative to the fifth axis 548. A first stop 556 and a second stop 560 are located on an eighth or channel surface 564 of the lock channel 552. The channel surface 564 defines a bolt or second passage 568. The first stop 556 is closer to the lock slot 540 than the second stop 560, and the second stop 560 is closer to the third opening 536 than the first stop 556. A first edge 572 defines the shape of the third opening 536, and may have a chamfered shape.

Figure 14:
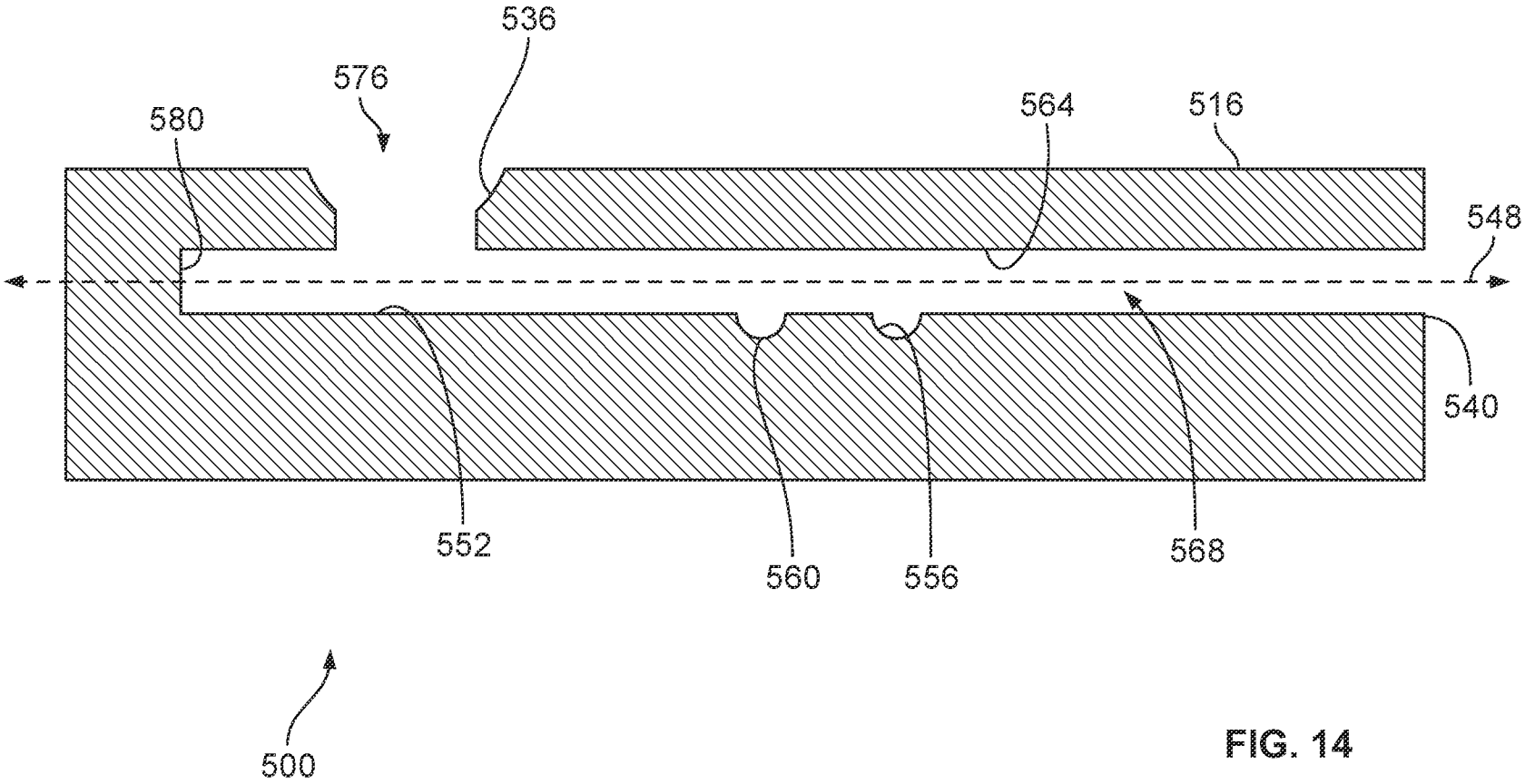
FIG. 14 is a schematic representation of a sectional view taken along line 14-14 of FIG. 13.
Figure 15:
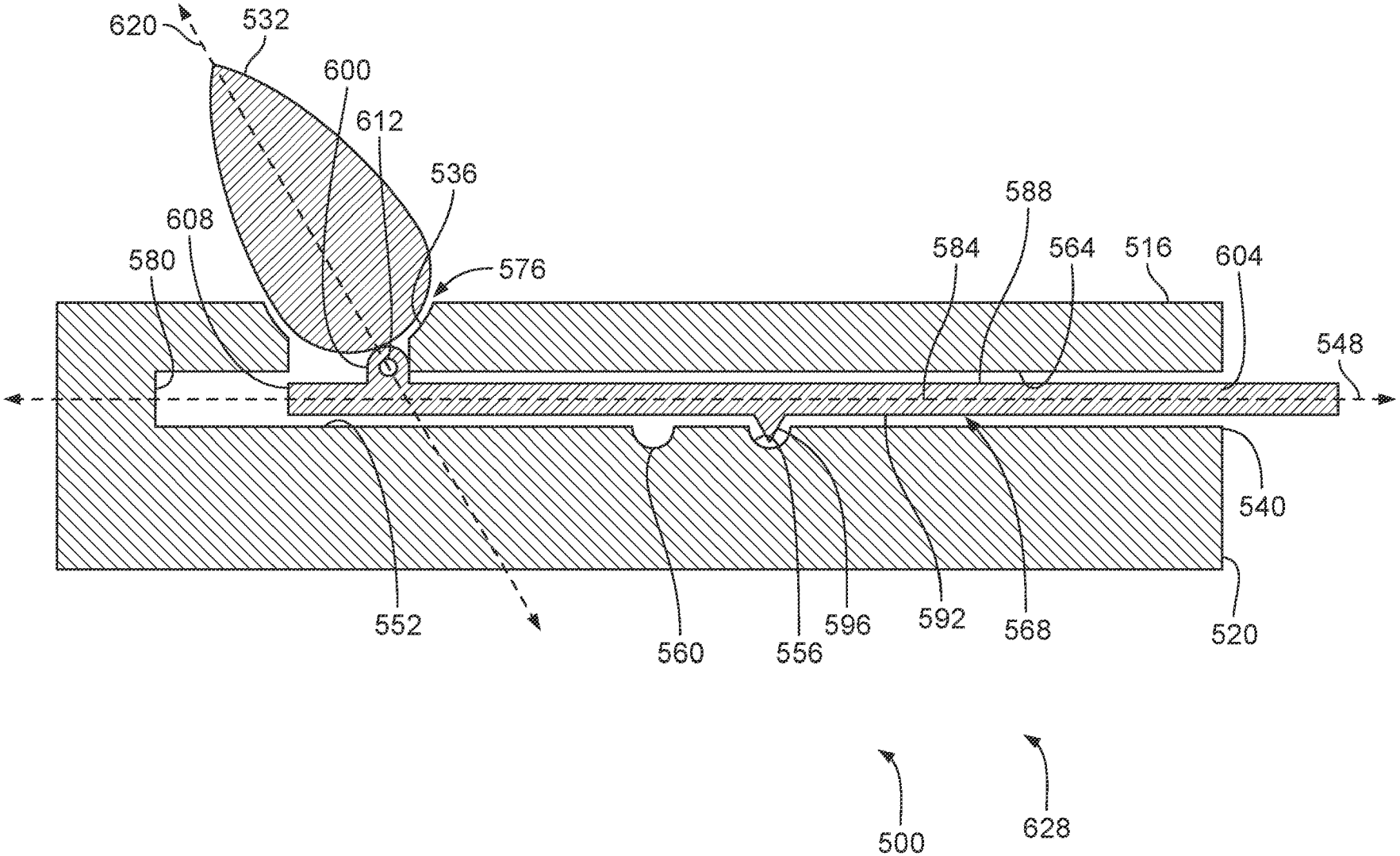
FIG. 15 is a schematic representation of a sectional view taken along line 15-15 of FIG. 13 in a locked configuration.
Figure 16:
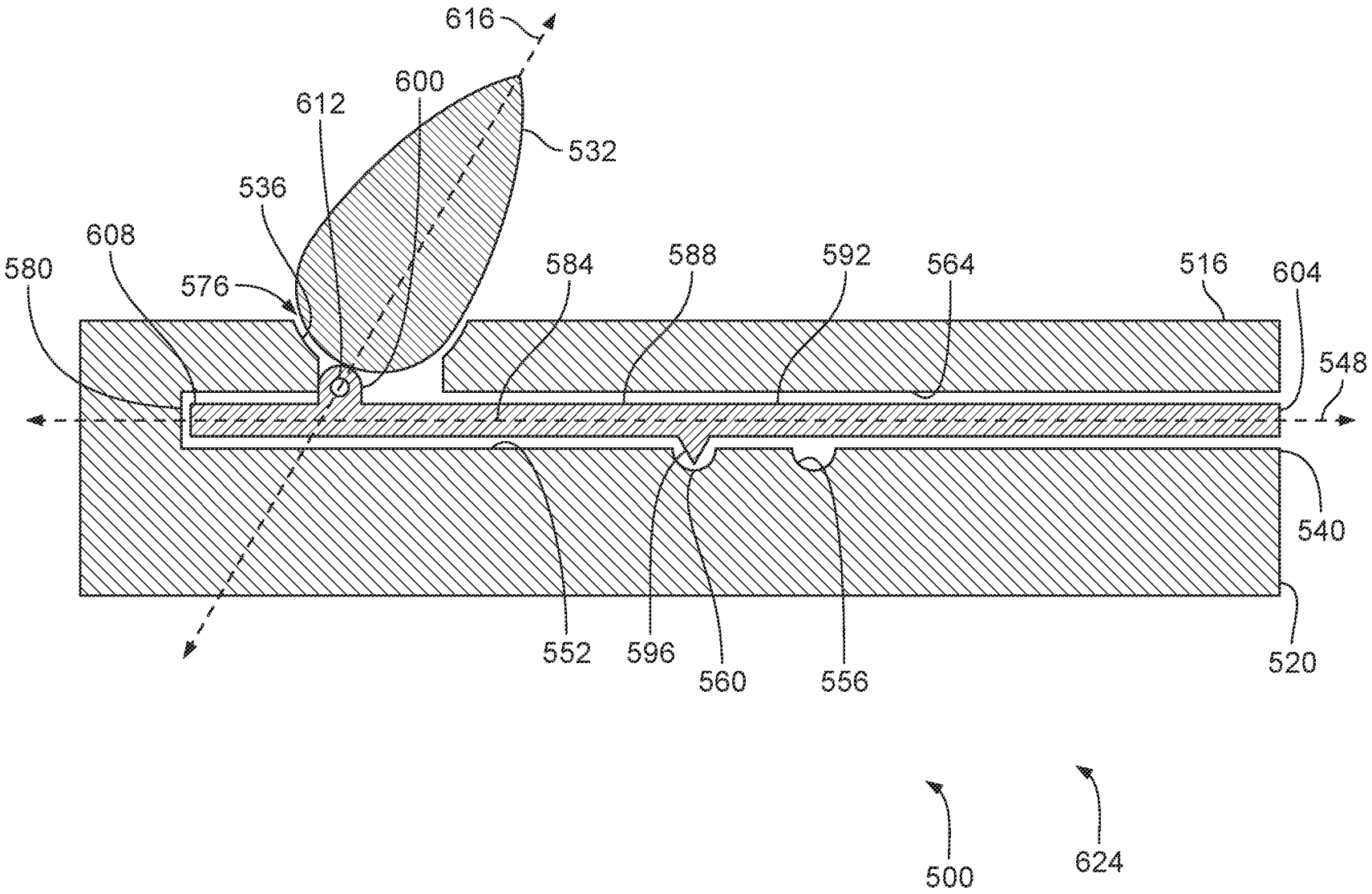
FIG. 16 is a schematic representation of a sectional view taken along line 16-16 of FIG. 13 in an unlocked configuration.

Referring to FIGS. 14-16, which depict sectional views of the handle 500, the third opening 536 defines a third passage 576 between the outer handle surface 516 of the handle 500 and the channel surface 564 of the lock channel 552. The channel surface 564 includes a ninth or rear surface 580 that is the farthest surface from the lock slot 540 in the lock channel 552. Referring to FIGS. 15 and 16, a lock bolt 584 has a lock shaft 588 configured to fit within the lock channel 552. The lock shaft 588 has a sixth body 592. The sixth body 592 includes a stop or first retainer 596, a toggle or second retainer 600, a lock or second end 604, and a recess or third end 608. The first retainer 596 is configured to selectively engage the first stop 556 or the second stop 560 to create a stable position for the lock bolt 584 when the first retainer 596 is engaged with the first stop 556 or engaged with the second stop 560, and an unstable position for the lock bolt 584 when the first retainer 596 is not engaged with either the first stop 556 or the second stop 560. In this way, the handle 500 can provide a bi-stable positioning system.

Referring to FIGS. 15 and 16, the second retainer 600 is configured to pivotally retain a toggle or fourth end 612 of the toggle 532. When the second retainer 600 of the lock bolt 584 and the fourth end 612 of the toggle 532 are pivotally connected, the toggle 532 has a forward tilt 616 toward (see FIG. 16) the lock slot 540 and a rearward tilt 620 away (see FIG. 15) from the lock slot 540. The forward tilt 616 and the rearward tilt 620 are defined through a longitudinal extent of the toggle 532 and form an angle relative to the fifth axis 548. In some embodiments, the forward tilt 616 is equal to but inverse of the rearward tilt 620 relative to the fifth axis 548. In some embodiments, the forward tilt 616 and the rearward tilt 620 are disposed at different angles, apart from being inverse, from one another. In some embodiments, the forward tilt 616 and the rearward tilt 620 are not inverse of one another and, instead, the forward tilt 616 and the rearward tilt 620 are simply disposed at different angles from one another, such that articulating the toggle 532 between or among different angular positions relative to the fifth axis 548 results in different functions or actuations. The second end 604 is configured to selectively retract into the second passage 568 in a retracted or unlocked configuration 624 (see FIG. 16) and to extend beyond the second passage 568 in an extended or locked configuration 628 (see FIG. 15). The third end 608 is configured to selectively move closer to the rear surface 580 in the unlocked configuration 624 (see FIG. 16) and farther away from the rear surface 580 in the locked configuration 628 (see FIG. 15).

Referring to FIGS. 15 and 16, when the lock bolt 584 is in the unlocked configuration 624 (see FIG. 16), the first retainer 596 is engaged with the second stop 560, the second retainer 600 is closer to the third end 608 than when the lock bolt 584 is in the locked configuration 628 (see FIG. 15), the second end 604 is closer to the third end 608 than when the lock bolt 584 is in the locked configuration 628 (see FIG. 15), and the toggle 532 is positioned in the forward tilt 616 toward the lock slot 540. When the lock bolt 584 is in the locked configuration 628 (see FIG. 15), the first retainer 596 is engaged with the first stop 556, the second retainer 600 is farther from the third end 608 than when the lock bolt 584 is in the unlocked configuration 624 (see FIG. 16), the second end 604 is farther from the third end 608 than when the lock bolt 584 is in the unlocked configuration 624, and the toggle 532 has the rearward tilt 620 away from the lock slot 540.

Referring to FIGS. 5 and 15, the second end 604 of the lock bolt 584 extends outside of the second passage 568 (see FIG. 15). The second end 604 is configured to engage the first sidewall 268 of the recessed surface 264 (see FIG. 5). When the lock bolt 584 is in the locked configuration 628 (see FIG. 15), the second end 604 contacts the first sidewall 268 and the amount of desired tension in the cable twist fastener 244, the rigid twist fastener 376, or the slat twist fastener 724 can be selected and maintained. The first stop 556 is engaged with the first retainer 596 to ensure that the second end 604 stays engaged with the first sidewall 268. Referring to FIG. 16, when a user desires to change the tension, such as to remove the article of footwear 200, 700, or to increase the tightness of the panel 216, the user simply flips the toggle 532 to the second stable bi-stable position, which is the unlocked configuration 624 (see FIG. 16). The toggle 532 is flipped by overcoming the strength of the engagement between the first retainer 596 and the first stop 556. The flipping of the toggle 532 moves the lock bolt 584 to the unlocked configuration 624 (see FIG. 16) by applying the forward tilt 616 to the toggle 532. By applying the forward tilt 616 to the toggle 532, the first retainer 596 is directed to engage with the second stop 560. Referring to FIG. 16, when the second end 604 is in the unlocked configuration 624, the first sidewall 268 (see FIG. 5) is not engaged, and the downward force 236 on the panel 216 (see FIG. 4) can be adjusted to make the removal of the article of footwear 200, 700 easier, with a device that does not require shoelaces.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An article of footwear, comprising:

an upper attached to a sole structure; and a fastener including an actuator mechanism disposed within a first cavity formed at a heel end of the sole structure, wherein the actuator mechanism is operably coupled to a plurality of cables including a first cable that extends along the sole structure from a heel region to a midfoot region of the article of footwear and extends from the sole structure to a portion of the upper, wherein the fastener includes a winding assembly having a first core and a second core that are configured to store a portion of the plurality of cables, and wherein rotation of the actuator mechanism is configured to rotate the first cable within the first core and the second core to tighten or loosen the article of footwear within the midfoot region.

2. The article of footwear of claim 1, wherein the upper is operably coupled to a panel with a plurality of eyelets.

3. The article of footwear of claim 1, wherein the actuator mechanism is configured to rotate about a first axis.

4. The article of footwear of claim 1, wherein the actuator mechanism further comprises a cylindrical body and a release mechanism.

5. The article of footwear of claim 4, wherein the actuator mechanism comprises a plurality of grips that project from an outer surface that are configured to facilitate a rotation of the actuator mechanism about the first axis.

6. The article of footwear of claim 1, wherein the fastener further comprises a shaft that is at least one of a braided shaft or a rigid shaft.

7. The article of footwear of claim 6, wherein the shaft comprises a plurality of wires embedded in the sole structure that are configured to extend from the winding assembly along a second axis.

8. The article of footwear of claim 6, wherein the plurality of cables extend from a plurality of eyelets to a plurality of first openings located on a first surface of the midsole.

9. The article of footwear of claim 6, wherein the winding assembly comprises an intermediate portion that is disposed between and connects the first core and the second core.

10. The article of footwear of claim 9, wherein the first core has a first diameter which is greater than a second diameter of the intermediate portion.

11. An article of footwear, comprising:

an upper attached to a sole structure; and a fastener including an actuator mechanism disposed at a heel end of the sole structure and a plurality of cables including a first cable extending from the sole structure to a portion of the upper, wherein the actuator mechanism is operably connected to the first cable, wherein the fastener includes a toggle that is configured to be rotated to selectively adjust the fastener between a locked configuration and an unlocked configuration, wherein the fastener includes a winding assembly having a shaft that operably connects the actuator mechanism to the first cable, and wherein rotation of the actuator mechanism in a first direction causes rotation of the shaft that applies a tensioning force on the first cable.

12. The article of footwear of claim 11, wherein the fastener further comprises a housing in which the shaft is disposed.

13. The article of footwear of claim 12, wherein the shaft comprises a plurality of wires that are configured to extend from the winding assembly along a second axis embedded in the sole structure.

14. The article of footwear of claim 13, wherein the housing comprises an intermediate portion that includes a plurality of openings configured to receive the plurality of cables and a cavity configured to receive the shaft, wherein a third axis is defined by the housing and intersects the shaft, and wherein the plurality of openings are perpendicular with respect to the third axis.

* * * * *